US005461989A

United States Patent [19]

Grandclement et al.

[11] Patent Number: 5,461,989

[45] Date of Patent: Oct. 31, 1995

[54] TABLE IN PLASTIC MATERIAL

[75] Inventors: Charly Grandclement; Bruno Magnin, both of Oyonnax, France

[73] Assignee: Grosfillex S.A.R.L., Oyonnax, France

[21] Appl. No.: 88,218

[22] Filed: Jul. 6, 1993

[30] Foreign Application Priority Data

Jul. 3, 1992 [FR] France ..... 92 08276

[51] Int. Cl.[6] ..... A47B 3/06

[52] U.S. Cl. ..... 108/153; 108/27; 312/140.3

[58] Field of Search ..... 108/27, 153, 154, 108/157, 901, 180, 65, 69; 312/140.3, 140.4

[56] References Cited

U.S. PATENT DOCUMENTS

| | | | |
|---|---|---|---|
| 2,940,805 | 6/1960 | Nordmark | 108/27 |
| 3,490,602 | 1/1970 | Wentzel | 108/27 X |
| 4,754,714 | 7/1988 | Drumm | 108/159 X |
| 4,951,576 | 8/1990 | Cobus et al. | 108/901 X |
| 5,261,334 | 11/1993 | Chevoor | 108/153 |

FOREIGN PATENT DOCUMENTS

| | | | |
|---|---|---|---|
| 0274362 | 7/1988 | European Pat. Off. . | |
| 1442480 | 5/1966 | France . | |
| 2070314 | 9/1971 | France . | |
| 2274860 | 1/1976 | France . | |
| 1002175 | 8/1965 | United Kingdom | 106/29 |

*Primary Examiner*—José V. Chen
*Attorney, Agent, or Firm*—Poms, Smith, Lande & Rose

[57] ABSTRACT

The table includes, on the one hand, a flat panel provided on the border thereof with a downwardly projecting skirt, and on the other hand, a frame structure having a downwardly projecting eccentric sectional belt and defining an upwardly open hollow, the flat panel being fixed on the frame structure in order to constitute a top, by first snap-engaging elements cooperating with the frame structure, the eccentric belt of which is fitted with legs. The frame structure is an assembly of section pieces having edges, these section pieces being interconnected but without connection webs, so that the flat panel rests only on the edges of these section pieces; the frame structure further includes a peripheral sectional belt with which the first snap-engaging elements cooperate, this peripheral sectional belt thus forming with the projecting skirt of the panel a thick element which provides a hand grip if the table has to be moved.

12 Claims, 3 Drawing Sheets

FIG. 2
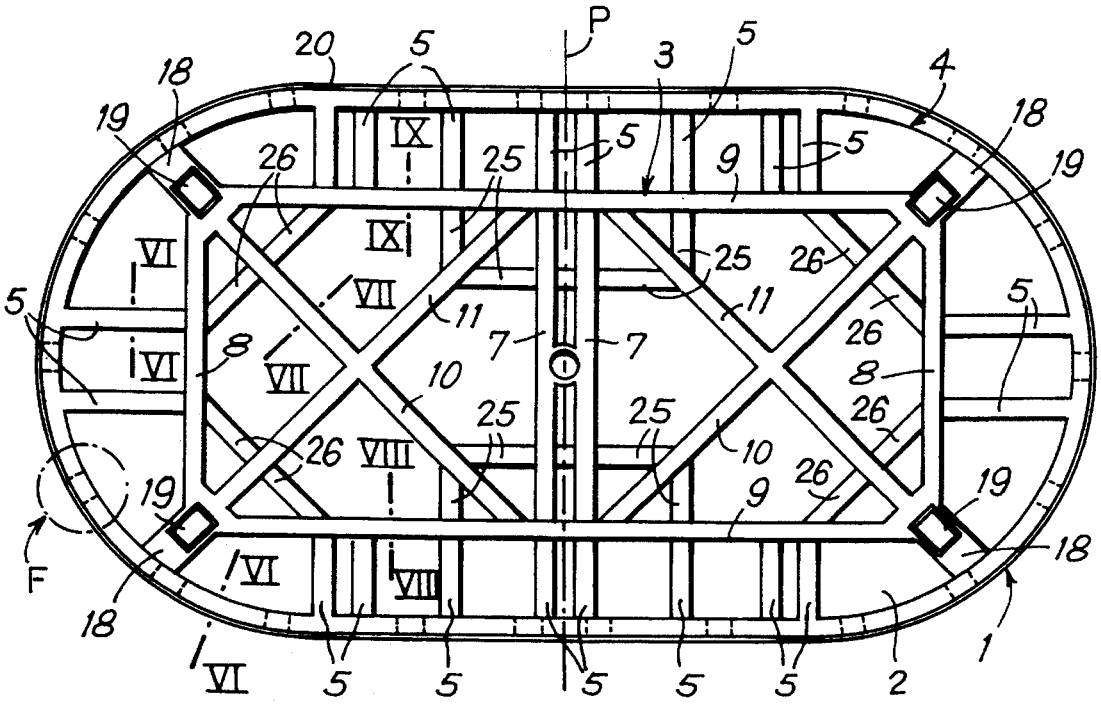
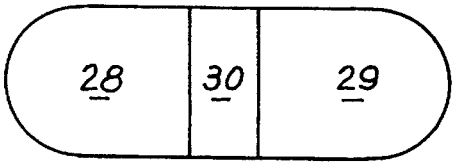
FIG. 3
FIG. 1
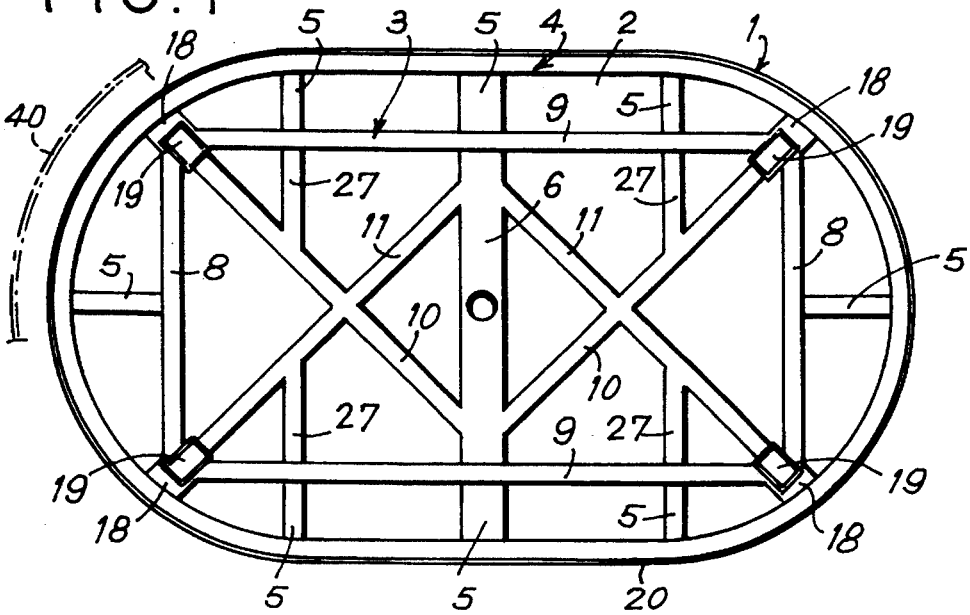

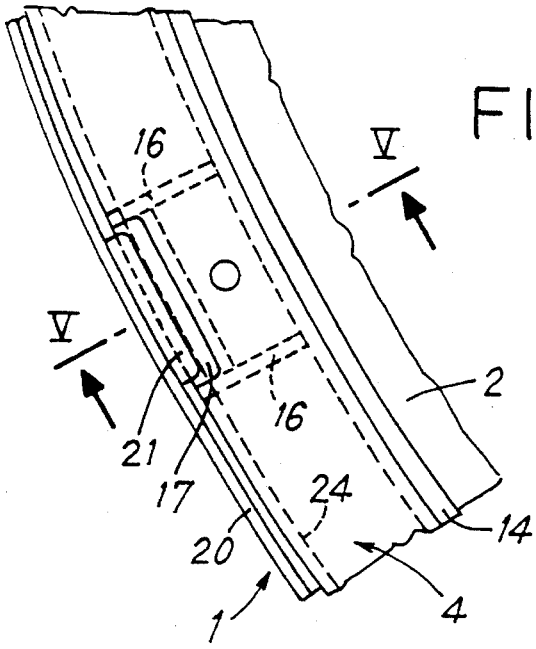
FIG. 4
FIG. 5
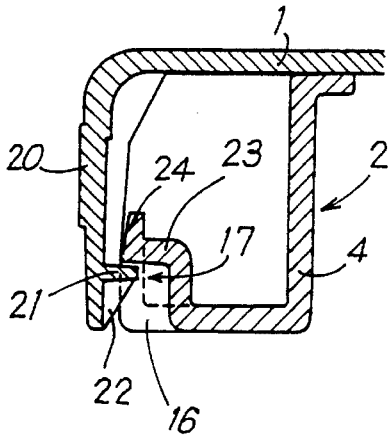
FIG. 6
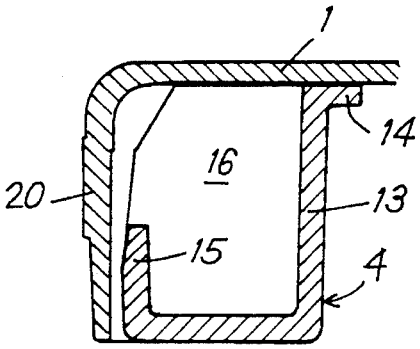
FIG. 8
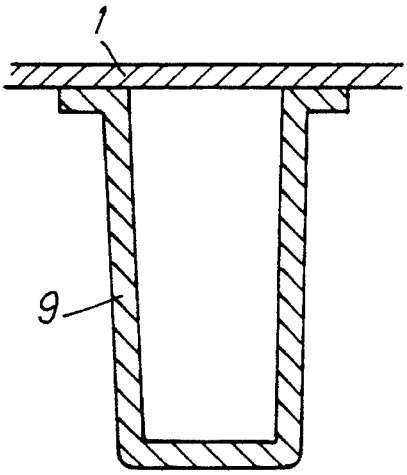
FIG. 7
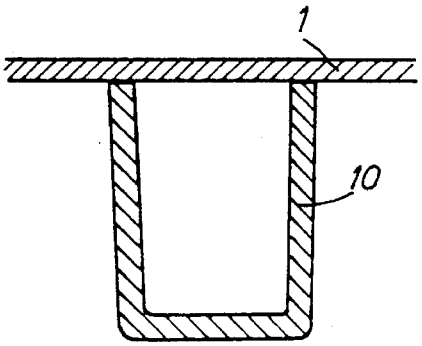

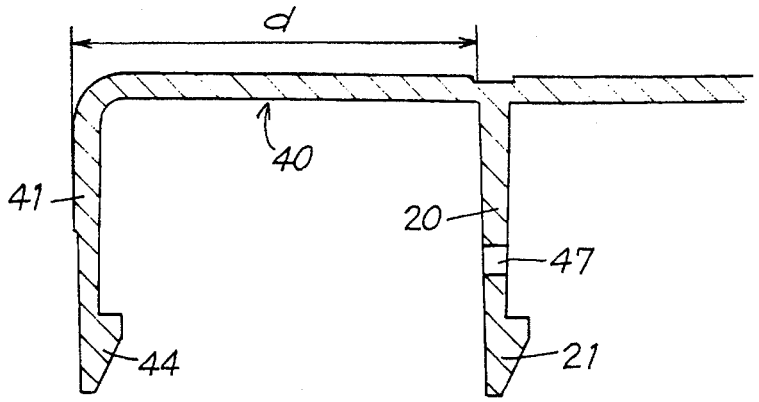
FIG. 12
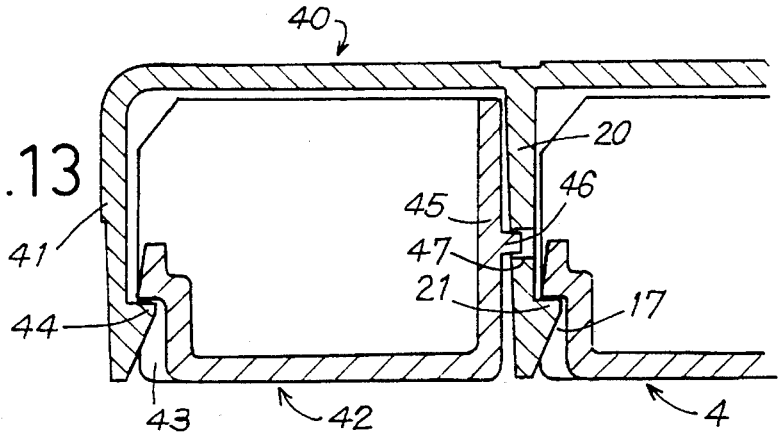
FIG. 13
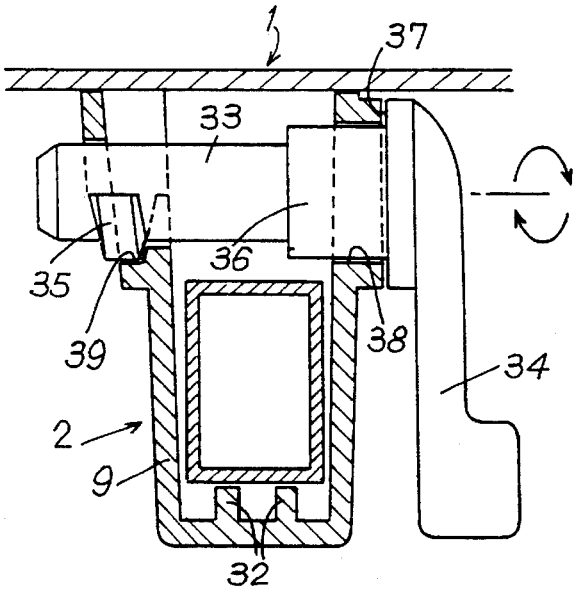
FIG. 9
FIG. 10
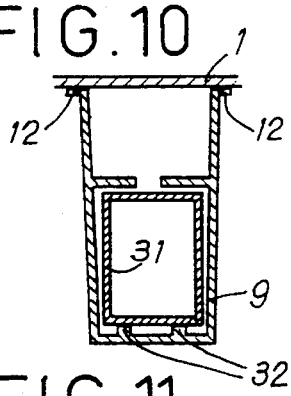
FIG. 11
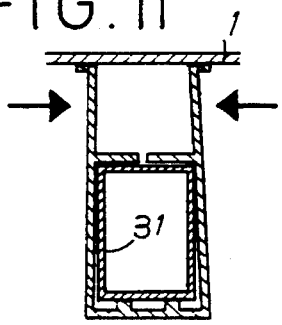

TABLE IN PLASTIC MATERIAL

FIELD OF THE INVENTION

The present invention relates to a table in plastic material, preferably for outdoor use.

BACKGROUND OF THE INVENTION

French Patent No. 1,442,480 describes such a table which comprises a flat top panel resting on a frame structure, both the panel and structure being produced in preferably reinforced synthetic resin.

The frame structure is a plate on which U-sections are formed, projecting downwardly and being open upwardly on the panel side. Said U-sections constitute an eccentric belt presenting in plan view a rectangular outline with crosspieces joining the big sides of said belt.

The panel and structure comprise peripheral edges which are apart from said belt and fittable one into the other.

The panel is fixed to the structure either by adhesive means of by clamps or other locking elements joining the edges together.

Legs are fixed on the eccentric belt of the frame structure.

This known table has the advantage of being solid and dimensionally stable, yet the disadvantage of being relatively costly due to the nature of the materials used, to their weight, to the existence of the plate and to the production of the adhesive bonding. Another disadvantage resides in the fact that, for moving the table, the hands must grip thin edges which give an impression of fragility.

SUMMARY OF THE INVENTION

It is the object of the invention to make the table lighter in order to reduce its cost, and to give it a comfortable impression by giving it "some grip", i.e. by dimensioning it so that all the parts to be gripped are relatively thick.

Another object of the invention is to allow the production of two tables with different sized tops, by changing only the top panel.

A final object of the invention is to allow the ready transformation of a one-piece table into an extendable table, just by cutting the one-piece table into two halves and fitting it with slides and clamping devices enabling the table to be locked with or without extra leaves.

This object is reached according to the present invention with a table reproducing the following means from the known table: on the one hand, a flat panel provided on its border with a downwardly projecting skirt, and on the other hand, a frame structure having a downwardly projecting eccentric sectional belt and defining an upwardly open hollow, the flat panel being fixed on the frame structure in order to constitute a top, by means of snap-engaging elements cooperating with the frame structure, the eccentric belt of which is fitted with legs, and according to the invention:

the frame structure is an assembly of section pieces which are interconnected but without connection web, so that the panel rests only on the edges of said section pieces, and said structure comprises a peripheral belt with which said snap-engaging elements cooperate, said peripheral belt thus forming with the skirt of the panel a thick element which provides a hand grip if the table has to be moved.

According to one particularly advantageous embodiment, the frame structure is adapted to cooperate with a panel of similar outline as the peripheral sectional belt, or with at least a larger panel comprising, besides said projecting skirt, an extending bordering part and a bordering skirt jutting out under said extending bordering part.

The space between the two skirts of the panel is filled with pieces of U-sections which are placed end-to-end and upwardly open, snap-engaging ensuring the fastening of the peripheral skirt on the outer flange of said added-on U-sections, in order to form a grip.

The eccentric belt has, in plan view, a rectangular outline and is joined to the peripheral belt by sectional crosspieces, the longitudinal section pieces of said eccentric belt being joined together by at least one median section piece, and with the latter as well as with the sectional crosspieces of said belt, by crosswise section pieces.

According to another embodiment of the invention, the top part can be divided into two halves which are adapted to be placed end-to-end or along at least one extension leaf; a tubular slide is then mounted in the two halves of each longitudinal section piece of the eccentric belt for supporting a leaf when the top halves are drawn apart, the flanges of each half of longitudinal section piece cooperating with a clamping device which tends to bring them closer together in order to immobilize the corresponding slide by clamping.

BRIEF DESCRIPTION OF THE DRAWINGS

The invention will be more readily understood on reading the following description with reference to the accompanying drawings, in which:

FIGS. 1 and 2 are plan views showing a first embodiment of the underpart of respectively, a small one-piece table and a large one-piece table, according to the invention, FIG. 3 is a plan view of a second embodiment of the large table shown in FIG. 2, adapted to be extendable, FIG. 4 is an enlarged view of the ringed item in FIG. 2, designated by arrow F, FIG. 5 is a cross-section taken along line V—V of FIG. 4, FIGS. 6 and 8 are sectional views taken on the same scale as in FIG. 5, along lines VI—VI to VII—VII respectively of FIG. 2, FIG. 7 is a sectional view at cross piece 10, FIG. 9 is a view similar to that shown in FIG. 8 taken on the same scale along line IX—IX of FIG. 2, when the table is converted to become an extendable table according to FIG. 3, FIGS. 10 and 11 are diagrams similar to FIG. 9, but on a smaller scale, showing the locking of an extendable table, FIG. 12 is a view similar to FIG. 5, but on a different scale, showing a third embodiment of the table according to FIGS. 1 or 2, FIG. 13 is a view similar to FIG. 12 showing a variant embodiment.

Two tables of different dimensions are shown in FIGS. 1, 2 and 4 to 8 to illustrate a first embodiment of the invention.

Each one of these one-piece tables comprises a top part constituted by a flawlessly moldable flat panel 1 and by a frame structure 2 concealed by the panel resting over it. The panel and structure are in plastic material, such as polypropylene, a polyacrylonitrile butadiene styrene known on the market as ABS, and they are molded in one piece.

The frame 2 is an assembly of upwardly open and downwardly closed section pieces, such pieces making the assembly convenient for gripping with the hand and giving the impression of a solid and strong mass.

Said section pieces constitute:

an eccentric belt 3 of rectangular outline, a peripheral belt 4 of oval outline whose long sides are parallel to those of the eccentric belt 3, sectional crosspieces 5 joining the belts together, one median crossbar 6 (FIG. 1) or two median crossbars 7 (FIG. 2) which extend in parallel to the transversal section pieces 8 or small sides of the eccentric belt 3 and joining up the longitudinal section pieces 9 or large sides thereof, section pieces 10 and 11, disposed crosswise in the empty spaces of the eccentric belt 3 separated by the median crossbar or crossbars 6 or 7.

All said section pieces are joined together and have been molded together to form a one-piece structure 2. Spaces are thus left between the section pieces and the structure 2 contains no webs to join the pieces.

The eccentric belt 3 is constituted by relatively high Ω-sections 8 and 9, as shown in FIGS. 8 and 9 to 11, so that the panel 1 rests on the flanges 12 of said sections. The eccentric belt 3 may also be described as a first peripheral section piece defining an inner contour. The flanges 12 may also be described as free upper edges.

The peripheral belt 4 is constituted by a half-Ω section which is less high than the external flange 15, the whole assembly being likewise less high than said sections 8 and 9. The peripheral belt 4 may also be described as a second peripheral section piece defining a first outer contour. The panel 1 then rests on the flange 14 and on partitions 16 (FIGS. 4 and 6) molded with said section 4.

Said partitions in fact define, two by two, recesses 17 (FIGS. 4 to 6) designed to cooperate with snap-engaging members to be described hereinafter.

The crosswise section pieces 10 and 11 are extended beyond the angels of the peripheral belt 4 by bigger and thicker section pieces 18 designed for fixing the legs 19 by any suitable means: axial snap-engagement, engagement on one side by pivoting movement and fastening on the other side with screws or the like.

The panel 1 is bordered with a downward skirt 20 fitted on the peripheral belt 4 of the structure 2. Said panel is normally fixed to said structure with snap-engaging lugs 21 molded thereon and designed to engage in said recesses 17. For the snap-engagement of the lugs by elastic deformation of the skirt 20, said lugs are provided with inclined ramps 22 adapted to cooperate with conjugated inclined ramps 24 (FIG. 5) formed in the bottom 23 of the recesses 17. When the panel 1 rests on the structure 2, all the lugs 21 of the panel are snap-engaged in the recesses 16 of which the bottoms 23 oppose any untimely release.

The table illustrated in FIG. 2 differs from the small one by the number and distribution of the sectional crosspieces 5, by the presence of two crossbars 7 instead of only one 6 and by the particular disposition of section pieces 25 and 26 instead of 27 for reinforcing the crosses 10, 11.

The large one-piece table according to FIG. 2 can readily become an extendable table according to FIG. 3. It suffices to divide the top 1, 2 according to the plane P by slightly adapting the mold or by cutting through molded parts. Two halves 28 and 29 are thus obtained between which can be inserted at least one extension leaf 30 (FIG. 3). Understandably, an adaptation is required to join the two halves, optionally to support the inserted leaf or leaves and to lock the table with or without leaves.

This then is the second embodiment of the invention where the table is provided with adaptation means as illustrated in FIGS. 9 to 11. These means comprise two tubular slides 31 each one being mounted for sliding in the two aligned halves of the corresponding longitudinal section piece 9 of the eccentric belt 3.

Advantageously, each slide 31 has a rectangular cross-section which is adaptable with a slight play in the section piece 9. For easier slidability, at least one rib 32 forming a sliding path has been molded on the bottom of section piece 9.

Moreover, means are provided for locking the table in open or closed position, said means doing so by moving the flanges of the section pieces 9 either closer in order to grip the slides or apart to release them. In the first case, the table is locked with or without a leaf. In the second case, the two halves are free and can be moved apart or close together.

Each locking means (FIG. 9) comprises a pin 33 equipped at one end with an operating handle 34 and with a helical thread 35 at the other. The pin is provided, close to the handle, with a cylindrical bearing surface 36 whose diameter is at least equal to the external diameter of the thread 35 and which leads to a shoulder member 37. The bearing surface 36 traverses a hole 38 forming a bearing and provided in one flange of the corresponding section piece 9, while the thread 35 cooperates with a tapping 39 provided in the other flange or in the helical edge of a hole. When the locking means is in position, and as long as the shoulder member 37 is in abutment against one flange of the section piece, the action of screwing in the pin causes the other flange to move in closer, thereby causing the clamping of the slide 31; by unscrewing the pin, the flanges of the section piece are moved apart and the slide is released.

If the slide 31 is mounted for free movement in the two halves 28 and 29, a pin 33 must be disposed on each half of section piece 9. If, on the contrary, the slide is fixed in one half of the section piece and freely movable in the other half, only one pin is necessary for each slide, which pin is then disposed on that half of the section piece 9 in which said slide is free to move.

A third embodiment is diagrammatically illustrated in FIGS. 12 and 13. The same frame structure 2 with the legs 19 can be used either with a panel 1 of identical outline (FIGS. 1 and 5) or with a larger panel 40 (FIGS. 12 and 13) which extends beyond the skirt 20 and has a downwardly projecting bordering skirt 41 situated at a substantially constant distance "d" from skirt 20.

Skirt 20 is provided with snap-engaging lugs 21 enabling the locking of the panel 1 on the frame structure 2. The skirt 41 can be left such as molded but it seems more advantageous, there again to improve comfort and to provide a handgrip, to equip this larger panel 40 with a filling giving the impression that the skirt 41 is thicker.

Such a filling can advantageously be of the illustrated type. It is constituted by a section piece 42 similar to section piece 4 in the structure 2, hence comprising recesses 43 designed to cooperate with lugs 44 of the skirt 40, said recesses 43 and lugs 44 being similar to those 17 and 21 of said section piece 9.

The section piece 42 is preferably molded in a plurality of pieces laid end-to-end. To keep them in position, it may be advantageous to position the inner flange 45 of said pieces 45 relatively to the peripheral skirt 20 of the panel. To this effect, studs 46 or other engagement elements project from said flange 45 and are engaged, when said pieces are fitted together slantwise, in conjugated holes 47 of the skirt 20.

In the illustrated example, the "gripping" possibility is given over a relatively great width by the assembly of section pieces 42 and 4. To reduce such width, it suffices to provide an empty space between said section pieces, for placing the fingers. In this case, the studs 46 can be replaced by spacers.

What is claimed is:

1. A table in molded plastic material comprising a flat panel, a frame structure and legs, said flat panel constituting a top of said table and having a lower face, said table further comprising a first peripheral skirt projecting downwardly from said flat panel, said skirt having an inner side, an outer side and a lower edge, said frame structure cooperating with said lower face of said flat panel and being composed of an assembly of first section pieces having free upper edges, said first section pieces being connected one to another without any connection web disposed between said first sections pieces, said lower face of said flat panel resting only on said free upper edges of said first section pieces, said first section pieces of said frame structure comprising first and second peripheral section pieces, said first peripheral section piece defining an inner contour and having said legs of said table depending therefrom, said second peripheral section piece defining a first outer contour and being disposed substantially against said inner side of said first peripheral skirt of said flat panel, the latter having first snap-engaging elements which cooperate with said second peripheral section piece in order to secure said flat panel to said frame structure, said second peripheral section piece having a lower face of which at least one part is disposed substantially coplanar with said lower edge of said skirt, so that said second peripheral section piece and said skirt form a first thick element which provides a hand-grip if the table has to be moved.

2. The table of claim 1, wherein the first peripheral skirt downwardly projects from an outline of the flat panel.

3. The table of claim 1, wherein said first snap-engaging elements comprise first lugs projecting inwardly from said inner side of said first peripheral skirt and presenting first inclined ramps, and wherein said first peripheral section piece has an outer side provided with first recesses presenting upper edges, said upper edges of said first recesses being adapted to cooperate with said first inclined ramps thereby causing an elastic deformation of said first peripheral skirt during an engagement contact of said first peripheral section piece relative to said first peripheral skirt until said first lugs penetrate into said first recesses.

4. The table of claim 1, wherein the flat panel further comprises a bordering part disposed outwardly from the first peripheral skirt and second engaging elements, and wherein the table further comprises a second peripheral skirt projecting downwardly from an outline of said bordering part, and having an inner side, an outer side and a lower edge.

5. The table of claim 4, wherein the flat panel comprises second snap-engaging elements, and wherein the table further comprises a bordering element composed of an assembly of second section pieces, each of which has ends and presents an inner flange, an outer flange and a lower face defining an upwardly open U-like section, said second section pieces being placed end-to-end between said first and second peripheral skirts and substantially covering a lower face of said bordering part of said flat panel, said second snap-engaging elements cooperating with said second section pieces in order to fasten said second peripheral skirt to said outer flanges of said second section pieces, and the lower edge of said second peripheral skirt being substantially coplanar with at least parts of said lower faces of said second section pieces so that said second section pieces and said second peripheral skirt form a second thick element which provides hand-grip if the table has to be moved.

6. The table of claim 5, wherein the first peripheral skirt comprises first engaging elements, and wherein the second section pieces of the bordering element comprise second engaging elements adapted to cooperate with said first engaging elements in order to ensure a positioning of the inner flanges of said second section pieces relatively to said first projecting skirt.

7. The table of claim 5, wherein said second snap-engaging elements comprise second lugs projecting inwardly from said inner side of said second peripheral skirt and presenting second inclined ramps, and wherein said bordering member has an outer side provided with second recesses presenting upper edges, said upper edges of said second recesses being adapted to cooperate with said second inclined ramps thereby causing an elastic deformation of said second peripheral skirt during an engagement contact of said bordering member relative to said second peripheral skirt until said second lugs penetrate into said second recesses.

8. The table of claim 1, wherein said first snap-engaging elements are lugs projecting inwardly and adapted to penetrate, by elastic deformation of said first peripheral skirt, due, during an engagement, to a contact of first inclined ramps, into recesses provided in said second peripheral section piece.

9. The table of claim 1, wherein said first peripheral section piece has, in a plan view, a rectangular outline and is joined to said second peripheral section piece by sectional crosspieces, longitudinal section pieces of said first peripheral section piece having flanges and being joined together by at least one median section piece, and with the latter as well as with said sectional crosspieces, by section pieces disposed crosswise.

10. The table of claim 9, wherein said top can be divided into two halves which are adapted to be placed end-to-end or along at least one extension leaf, a tubular slide being then mounted in two halves of each said longitudinal section piece of said first peripheral section piece for supporting said at least one extension leaf when said two halves of said table are drawn apart, said flanges of each said half of each said longitudinal section piece cooperating with a clamping device which tends to bring each said half of each said longitudinal section piece closer together in order to immobilize said tubular slide of each said longitudinal section piece.

11. The table of claim 10, wherein said clamping device is a pin provided with an operating handle and traversing said two halves of each said longitudinal section piece, said pin having a first end which is mounted for pivoting in a flange of said longitudinal section piece and comprising a shoulder for axial abutment, and a second end which is provided with a helical thread cooperating with an edge of a hole in said flange of said longitudinal section piece.

12. The table of claim 1, wherein said section pieces of said first peripheral section piece are Ω-sections and said section pieces of said second peripheral section piece are half-Ω sections so that said flat panel rests on edges of said sections, some at least of the other section pieces being U-Sections.

* * * * *